United States Patent [19]

Raue

[11] 4,116,481

[45] Sep. 26, 1978

[54] LIFTING SLINGS AND A METHOD FOR PRODUCING SAME

[75] Inventor: Karl Moritz Raue, Basel, Switzerland

[73] Assignee: Spanset Inter A.G., Basel, Switzerland

[21] Appl. No.: 752,954

[22] Filed: Dec. 20, 1976

[30] Foreign Application Priority Data

Dec. 24, 1975 [GB] United Kingdom ..... 52785/75

[51] Int. Cl.[2] ..... B66C 1/16

[52] U.S. Cl. ..... 294/74; 428/43

[58] Field of Search ..... 294/74, 67 E, 67 EA; 224/49, 55, 56, 57, 58; 57/141, 144, 158; 428/43

[56] References Cited

U.S. PATENT DOCUMENTS

| | | | |
|---|---|---|---|
| 2,357,182 | 8/1944 | Farmer | 294/74 |
| 3,425,737 | 2/1969 | Sutton | 294/74 |
| 3,547,752 | 12/1970 | Janssen | 428/43 |
| 4,022,507 | 5/1977 | Marino | 294/74 |

*Primary Examiner*—James B. Marbert

*Attorney, Agent, or Firm*—Sughrue, Rothwell, Mion, Zinn and Macpeak

[57] ABSTRACT

A load-lifting sling comprises two or more spaced fibre bundles each obtained by winding fibre longitudinally around a first loop of strip material, such as paper or plastics sheet. The first loop of strip material is then bonded to a second strip material covering the fibre bundles and the strip material is adapted to be divided lengthwise, for example by a line of perforations, to provide a lashing component of the sling. The invention also relates to the production of such a sling.

9 Claims, 3 Drawing Figures

LIFTING SLINGS AND A METHOD FOR PRODUCING SAME

The present invention relates to an endless lifting sling and a method for producing same.

A previously proposed endless lifting sling consists of a strip of webbing which has its ends bonded together to form an endless loop. Separate lashing loops are used to enable a load that is to be lifted by the sling to be consolidated and secured. The disadvantages of this type of sling are that the joint in the sling weakens it and that the lashing loops have to be made separately and, therefore, increase the cost.

In order to avoid the sling being weakened by a joint, it has been proposed to make a sling from a coil of fibres in which each loop of the coil is bonded to the adjacent loop or loops. This has the disadvantages of being very stiff in use and the ends of the coil of fibres tend to creep so that the sling stretches. Furthermore, separate lashing loops are still required.

An object of the present invention is to obviate or mitigate the above disadvantages.

According to a first aspect of the present invention, there is provided a load-lifting sling comprising two or more spaced fibre bundles each obtained by winding fibre longitudinally around a first loop of strip material which is then bonded to a second loop of strip material, the strip material being adapted to be divided lengthwise to provide a lashing component of the sling.

According to a second aspect of the present invention, there is provided a method of making a load-lifting sling as defined in the first aspect of the present invention, comprising the steps of bonding the ends of a first strip of material together and supporting it in a loop formation under tension, winding fibre longitudinally around said first strip to form two or more spaced fibre bundles, and bonding a second strip of material to the first strip of material to cover the fibre bundles, the strips of material being divisible lengthwise to provide a lashing component of the sling.

The present invention will not be described by way of example with reference to the accompanying drawings, in which.

Figure 2:
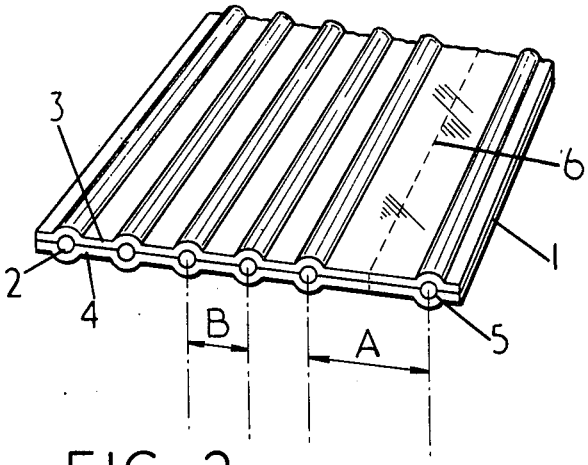
FIG. 2 is a sectional view of part of a finished sling.

A sling 1 according to the invention as shown in FIG. 2, consists of a number of spaced parallel bundles or hanks of fibres 2 wound longitudinally around and sandwiched between two outer endless strips of material 3 and 4 forming an endless loop. The two outer strips of material 3 and 4 are bonded together around their edges and in the areas between the fibre bundles to secure the bundles in their spaced position around the loop and to form a sling 1 of a width suitable for supporting a given load. At one side of the sling 1 at least one of the separate fibre bundles, as shown at 5, is spaced apart from the rest by a slightly greater distance A than that distance B between each of the fibre bundles, thus forming two spaced sets of bundles. Between these two sets of bundles, the sling may be torn along a line of perforations 6 to give two at least partially separate loops of different width. The loop of smaller width forms a lashing part of the sling and that of greater width a lifting or supporting part of the sling. The purpose of these two parts will be described later.

The outer strips of material 3 and 4 are preferably made of strong paper or from a synthetic film and the fibres are also preferably of a synthetic material. The width of the sling and the number of fibres in each bundle 2 can be varied according to the support and strength required from the sling. The number of fibre bundles in and the width of the lashing and lifting parts of the sling can also be adjusted according to requirements.

Figure 1:
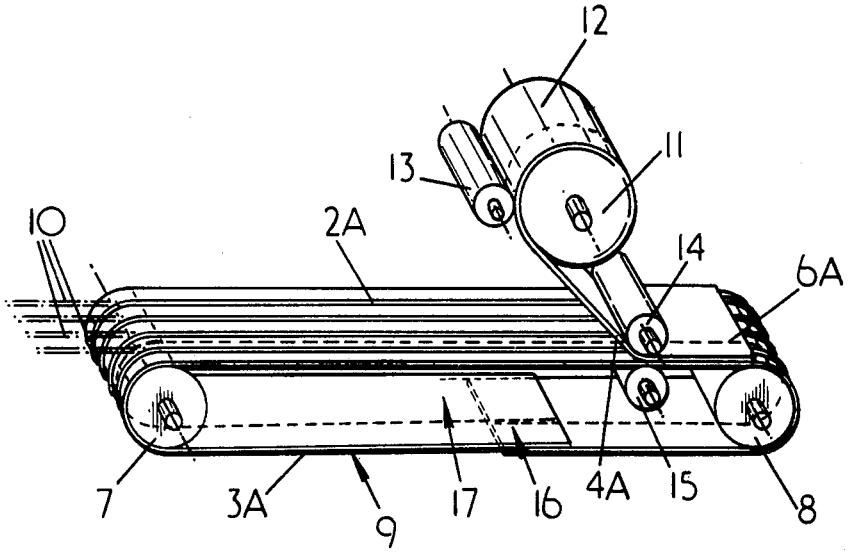
FIG. 1 is a perspective diagrammatic view of apparatus for making a lifting sling, the sling being shown in a partially completed condition.

To make the sling 1 described above, a first strip of material 3A is cut to the required length and wound around two spaced horizontal rollers 7 and 8, as shown in FIG. 1. The ends of the strip 3A are bonded together to form a loop 9 and the distance between the rollers 7 and 8 is adjusted so that the loop 9 is held under a slight tension. The required number of fibres 10 are arranged longitudinally parallel with and stretched over one side of the loop 9. The ends of the fibres 10 are attached to the loop 9 with an even regular spacing corresponding to the distance B except at one side where a slightly greater space corresponding to distance A is left between one of the fibres 10 and the rest. The rollers 7 and 8 are now rotated so that the fibres 10 are wound longitudinally around the loop 9 as it rotates to form spaced bundles 2A and the number of fibre turns in each bundle 2A is predetermined according to the final strength of sling that is required. When the bundles 2A are the correct size, the fibres 10 are cut and a second strip of material 4A is wound, from a roll 11 arranged immediately above the horizontal loop 9, around the loop 9 and pressed on top of the fibre bundles 2A to sandwich them between the two strips of material 3A and 4A. This second strip of material 4A has an adhesive applied to its side 12 which will be innermost in the finished sling, from a third roller 13 arranged adjacent the roll 11, so that when this strip of material 4A is applied and pressed against the first strip of material 3A forming the loop 9 they are bonded together with the fibre 2A bundles also being bonded between them. Two small pressing rollers 14 and 15 are arranged adjacent each other one inside and one outside the loop 9 to press the second outer strip of material 4A to the first. After one complete revolution of the loop 9 when the first strip of material 3A has been completely covered by the second strip 4A, this second strip 4A is cut to produce the sling. The sling is finished by being perforated along a longitudinal line 6A around the sling in the space between the two sets of fibres described above so that it has a narrow lashing part 16 and a broader lifting part 17.

It is to be understood that the sling could be made with two groups of fibre bundles arranged between three strips of material to form a "double sandwich" and so on. Similarly, more than one line of perforations can be made around the sling so that there are, for example, two outer lashing parts and an inner lifting part.

Figure 3:
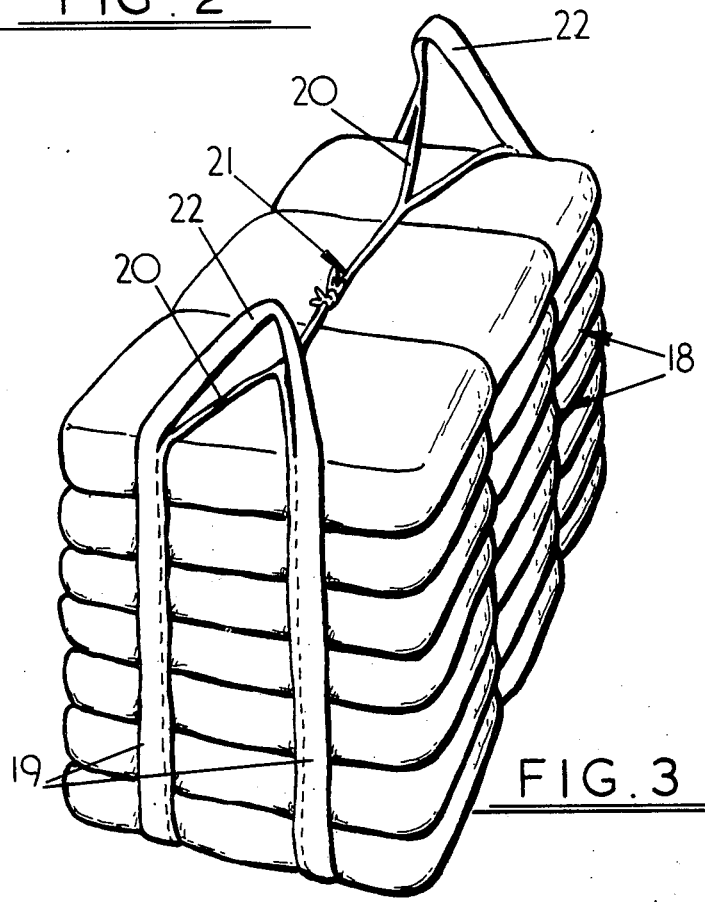
FIG. 3 shows one way in which the sling may be used.

In use, one or more slings 1 as described above can be employed according to the load that is to be lifted. Using one sling as shown in FIG. 3, a load 18 can be arranged over the two spaced sides 19 of the sling so that it will be evenly supported and the ends of the sling brought upwards around two opposing sides of the load 18. At the top of the load each of the two ends of the sling can be partially torn apart along the perforated lines to form a lasting "eye" 20 and these can then be secured together by rope or other similar connecting means 21. The two broader remaining loop ends 22 can then, for example, be hooked onto a lifting mechanism so that the load 18 can be hoisted. In this way the load 18 is secured and consolidated by the lashing parts 20 of the sling and lifted by means of the lifting part of the sling so that no further ropes or similar connecting means are required to lash or support the load.

In a similar way, two or more slings can be arranged in a parallel fashion around a load or arranged to cross diagonally beneath a load to support and enable it to be lashed together.

It can thus be seen that the sling according to the invention is versatile and complete in itself for preparing a load for lifting. It can be made with any required dimensions and with a great range of possible strengths. The lashing parts of the sling can be made, as required by the load, anywhere along the sling and if they are overstretched or broken by accident the strength of the lifting parts of the sling is unimpaired so that sling is safe in use.

What we claim is:

1. A load-lifting sling comprising a first loop of strip material, a second loop of strip material contigous with said first loop and bonded thereto, a plurality of fibre bundles located between said first and second loops of strip material and spaced one from another transversely across the width of the strip material of the sling, each fibre bundle comprising a length of fibre wound continuously as a hank, and means for allowing the strip material to be selectively longitudinally divisible between two fibre bundles along a portion of its length to provide at least one integral lashing component.

2. A sling as claimed in claim 1, wherein said means for allowing the strip material to be selectively longitudinally divisible comprises a line of weakness which enables the strip material to be divided lengthwise.

3. A sling as claimed in claim 2, in which the line of weakness is a line of perforation.

4. A sling as claimed in claim 2, in which the bundles of fibres are parallel and spaced evenly across the width of the sling apart from that spacing between two bundles which are immediately adjacent the line of weakness.

5. A sling as claimed in claim 1, in which the fibres are made from a synthetic material and the strips of material are made from paper and are bonded together by an adhesive.

6. A method of making a load-lifting sling comprising a first loop of strip material, a second loop of strip material contiguous with the first loop and bonded thereto, a plurality of fibre bundles located between said first and second loops of strip material and spaced one from another transversely across the width of the strip material of the sling, each fibre bundle comprising a length of fibre wound continuously as a hank, and means for allowing the strip material to be selectively longitudinally divisible between two fibre bundles along a portion of its length to provide at least one integral lashing component, said method comprising the steps of:

bonding the ends of said first strip material together and supporting it in a loop formation under tension, winding plurality of lengths of fibre continuously longitudinally around said first loop of strip material to form a plurality of transversely spaced fibre bundles across the width of the strip material with each fibre bundle comprising a hank of fibre, and bonding a second length of strip material to the loop of the first strip material to cover the fibre bundles and providing along a portion of the length of said bonded strip said means for allowing said strip material to be longitudinally divisible.

7. A method as claimed in claim 6, wherein said step of supporting said first strip of material in a loop formation under tension ccomprises placing said strip material on two adjustably spaced horizontal rollers, and wherein the step of winding comprises rotating said two adjustably spaced horizontal rollers to thereby wind fibre onto the strip.

8. A method as claimed in claim 6 in which the second strip of material is coated with adhesive before being applied to the first strip of material.

9. A method as claimed in claim 6, further comprising the step of arranging two pressing rollers adjacent each other, with one inside and one outside the looped first strip of material, and causing said pressing rollers to press the second strip material onto said first strip.

* * * * *